US007043936B2

(12) United States Patent
Jung et al.

(10) Patent No.: US 7,043,936 B2
(45) Date of Patent: May 16, 2006

(54) REFRIGERANT CONDENSER

(75) Inventors: Patrick Jung, Roth (FR); Siegfried Tews, Stuttgart (DE)

(73) Assignee: BEHR GmbH & Co., Stuttgart (DE)

( * ) Notice: Subject to any disclaimer, the term of this patent is extended or adjusted under 35 U.S.C. 154(b) by 187 days.

(21) Appl. No.: 10/492,190

(22) PCT Filed: Aug. 23, 2002

(86) PCT No.: PCT/EP02/09422

§ 371 (c)(1),
(2), (4) Date: Apr. 9, 2004

(87) PCT Pub. No.: WO03/031885

PCT Pub. Date: Apr. 17, 2003

(65) Prior Publication Data

US 2004/0244410 A1 Dec. 9, 2004

(30) Foreign Application Priority Data

Oct. 9, 2001 (DE) ..... 101 49 798

(51) Int. Cl.
*F25B 43/00* (2006.01)
*F25B 39/00* (2006.01)

(52) U.S. Cl. ..... 62/509; 62/474

(58) Field of Classification Search ..... 62/474, 62/509, 512; 165/110, 132
See application file for complete search history.

(56) References Cited

U.S. PATENT DOCUMENTS

| | | | | |
|---|---|---|---|---|
| 4,707,999 | A * | 11/1987 | Ohta et al. | 62/474 |
| 5,088,294 | A * | 2/1992 | Ando | 62/119 |
| 5,159,821 | A | 11/1992 | Nakamura | |
| 5,419,141 | A | 5/1995 | Burk | |
| 5,537,839 | A | 7/1996 | Burk et al. | |
| 5,992,174 | A | 11/1999 | Mittelstrass | |
| 6,341,647 | B1 | 1/2002 | Nobuta et al. | |
| 6,374,632 | B1 | 4/2002 | Nobuta et al. | |

FOREIGN PATENT DOCUMENTS

| | | |
|---|---|---|
| DE | 43 19 293 A1 | 12/1994 |
| DE | 199 26 990 A1 | 12/1999 |

(Continued)

*Primary Examiner*—Melvin Jones
(74) *Attorney, Agent, or Firm*—Foley & Lardner LLP

(57) ABSTRACT

The invention relates to a condenser (1) comprising an integrated collector (5) which is arranged parallel to one of the collector tubes (2) and is connected to said connector tube via two overflow opening (8 and 9). Said collector (5) is used to receive a drying/filtering unit (11). The condenser (1), consisting of tubes (3), ribs (4) and collector tubes (2), is produced by welding. According to the invention, the drying/filtering unit (11) is introduced into the collector (5) before the welding process and is positioned therein or connected thereto in a fixed manner. The collector (5) is then closed and the entire condenser (1) is welded. The connection between the drying/filtering unit (11) and the collector (5) is thus carried out before or during the welding process by means of welding. The invention is preferably used for air conditioning systems in motor vehicles.

11 Claims, 3 Drawing Sheets

FOREIGN PATENT DOCUMENTS

Figure 1:
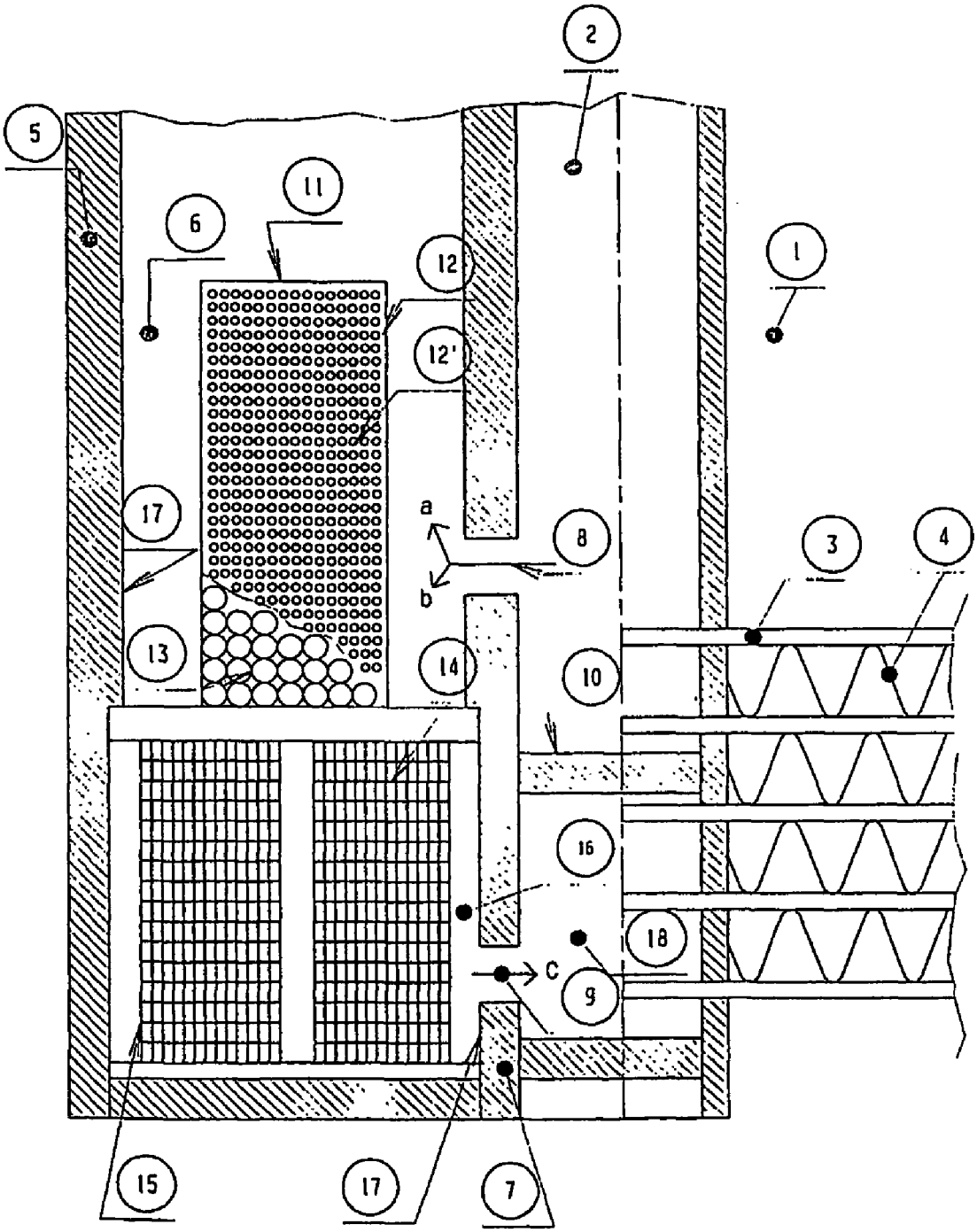

| | | | |
|---|---|---|---|
| DE | 100 04 276 | A1 | 8/2000 |
| DE | 199 57 307 | A1 | 5/2001 |
| EP | 0 668 986 | B1 | 8/1995 |
| EP | 0 669 506 | B2 | 8/1995 |
| EP | 0 689 041 | A1 | 12/1995 |
| EP | 0 867 670 | A2 | 9/1998 |
| EP | 1 006 323 | B1 | 6/2000 |
| EP | 1 202 007 | A1 | 5/2002 |
| FR | 2 746 908 | A1 | 10/1997 |
| FR | 2 750 761 | A1 | 1/1998 |
| JP | 2000-46444 | A | 2/2000 |
| JP | 2001-141332 | A | 5/2001 |

* cited by examiner

REFRIGERANT CONDENSER

The invention relates to a brazed refrigerant condenser which comprises a heat-exchanger network with flat tubes and corrugated ribs, collector tubes which have a fluid connection with the flat tubes, and also a collector which is arranged in parallel with a collector tube, accommodates a dryer and/or a filter in itself and has a fluid connection to the collector via two overflow openings—a condenser of this type is disclosed by EP 0 669 506 of the applicant.

This known condenser is what is known as a condenser module, in which a collector is arranged parallel to one of the collector pipes and is connected to the collector pipe via two overflow openings. As a result, the refrigerant overflows from the collector pipe into the collector, where there is a dryer, that is to say a container, normally made of plastic, which is filled with drying granules to dehydrate the refrigerant. After the refrigerant has flowed around or through the dryer, it passes through a filter screen into the lower region of the collector. The screen has the task of cleaning the refrigerant from contaminants in the form of extremely fine particles. After that, the refrigerant enters the collecting part of the condenser again via the lower overflow opening. In this design, all the metal parts, that is to say flat tubes, ribs, collector pipes and collectors, are brazed in the brazing oven, that is to say approximately at a temperature of 620° C. The plastic insert with the granules does not withstand such temperatures, for which reason it is put into the collector after the brazing, whereupon said collector is closed by means of a cover. The insert with drying granules can then also be replaced for maintenance purposes. Similar designs with an inserted dryer cartridge, which is also integrated with a filter screen as an installed part, emerge from further documents from the applicant, EP 0 689 041 B1 and EP 0 867 670 A2. Furthermore, condenser modules from the applicant have also become known which have only the dryer insert with granules, that is to say without a filter screen, that is to say EP 0 668 986 B1 and DE 43 19 293 C2. The common factor in all these designs is that the dryer insert, with or without filter screen, is mounted, that is to say positioned, in the collector only after the brazing process of the condenser. Following this introduction of the dryer/filter insert, the collector must be closed in a fluid-tight and pressure-tight manner. This requires, firstly, appropriate constructional measures in the form of an opening on the collector with a fitting cover and, secondly, additional operations following the brazing in order to mount the dryer insert. Of course, this entails corresponding costs, which are reflected in the price of the condenser module.

It is therefore an object of the present invention to improve a refrigerant condenser of the type mentioned at the beginning to the effect that the mounting of the dryer/filter insert is simplified and production costs of the entire condenser can be reduced.

This object is achieved by the features of patent claim 1 and those of method claim 11. The fact that the dryer including filter is brazed to the collector means that the condenser can be mounted completely before the brazing process, that is to say inclusive of dryer with drying material and filter. Thus, the subsequent introduction of the dryer/filter insert after brazing is dispensed with. Dryer and/or filter can also be adhesively bonded to the collector during the brazing process, for example by means of a temperature-resistant adhesive. Likewise, a form-fitting or frictional connection between the dryer/filter unit and the collector can already be produced before the brazing process, so that the unit is positioned in a fixed manner in the collector and can then be subjected to the brazing process without impairment. In all these solutions, it is a precondition that the drying material is temperature-resistant, that is to say the temperatures of about 620° C. occurring during the brazing process do not impair its function.

A form-fitting connection can be produced, for example, by arranging ring-like beads above and below the dryer/filter unit, and a force-fitting connection can be achieved by the housing of the dryer/filter unit being pressed into the collector, that is to say retained there by means of a press fit.

Further advantageous refinements of the invention emerge from the subclaims. The dryer material can either be present in the form of granules, which are enclosed in a perforated metal container, or it is used as a solid compound, for example as a cylindrical rod, which is connected to the filter insert and is thus fixed in the collector by brazing. The dryer/filter insert therefore consists of a metallic material, preferably an aluminum alloy, which can be brazed to the collector, which likewise consists of an aluminum alloy.

Figure 2:
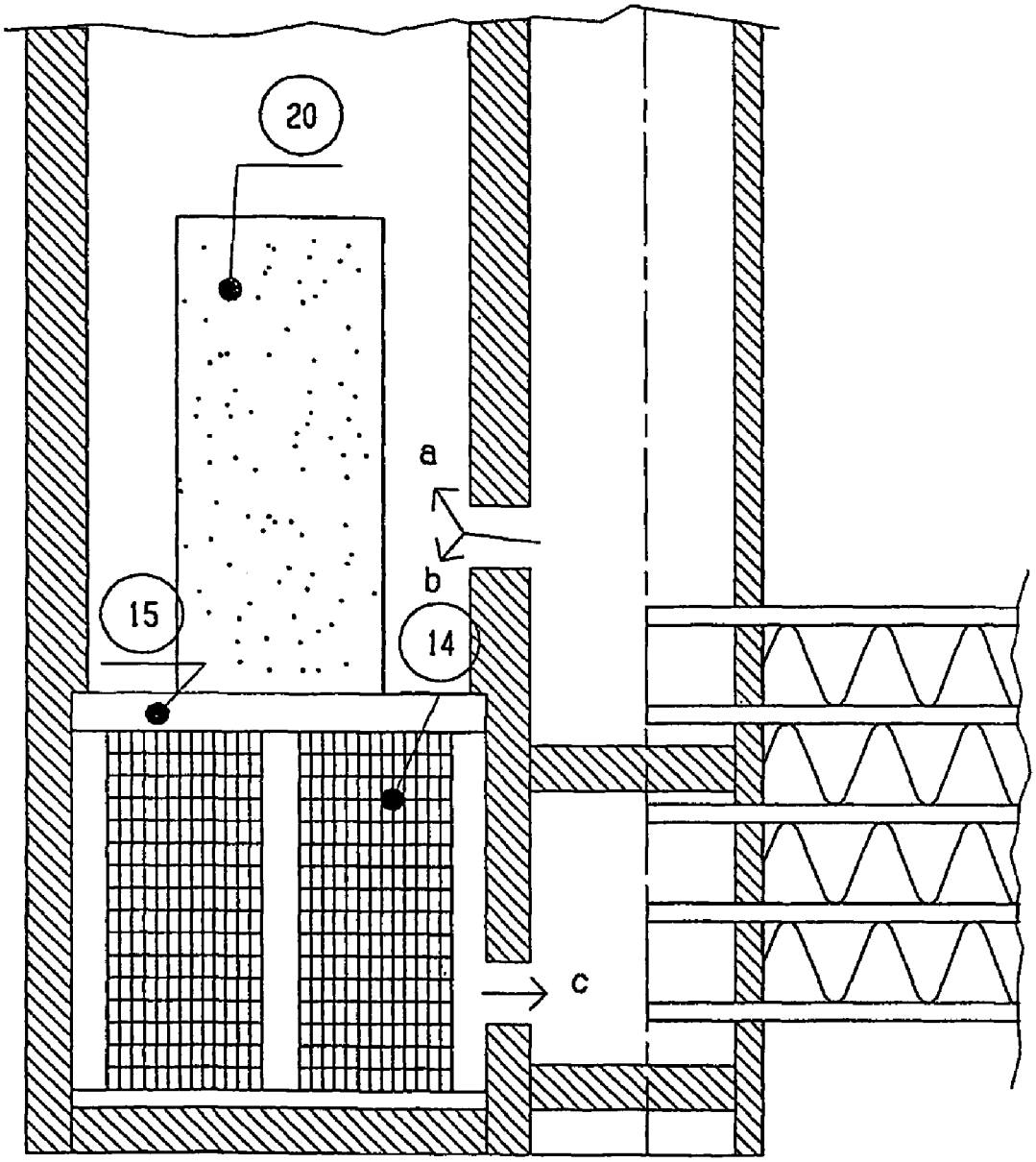
Figure 3:
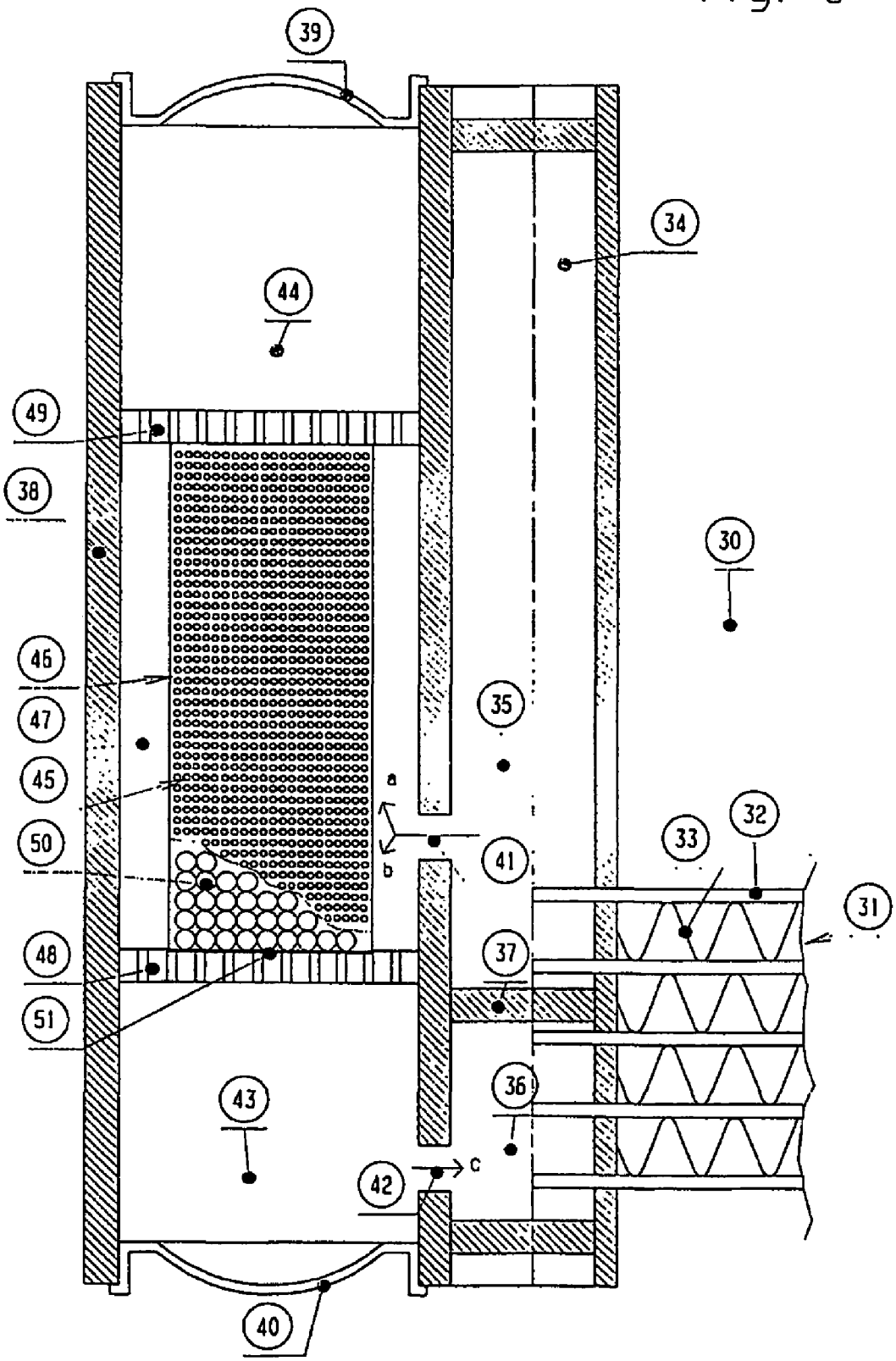

An exemplary embodiment of the invention is illustrated in the drawing and will be described in more detail in the following text. In the drawing:

FIG. 1 shows a detail from a condenser module with dryer/filter insert with granulated dryer material, FIG. 2 shows a detail from a condenser module with a dryer/filter unit with rod-like dryer of a solid compound and FIG. 3 shows a detail from a condenser module with a dryer sleeve and filter screen brazed in.

FIG. 1 shows a detail from a refrigerant condenser 1 such as is used in the refrigerant circuit of a motor vehicle for the air-conditioning of the passenger compartment. This condenser has a collecting tube 2 (the other is not illustrated), into which flat tubes 3 open, between which there are corrugated ribs 4 which are acted on by ambient air in order to dissipate heat. Provided in parallel with the collecting tube 2 is a collector 5, which has a fluid connection to the collecting tube via two overflow openings 8 and 9, between which there is a dividing wall 10 in the collecting tube 2. To this extent, this condenser is known; all the parts 2, 3, 4, 5 consist of an aluminum alloy and are brazed to one another in one operation in the brazing oven.

A dryer/filter insert 11 is built into the interior 6 of the collector 5. It comprises an upper part, a perforated metal cage 12, in which the dryer material is enclosed in the form of granules 13. The lower part of the insert 11 comprises a filter screen 14, whose outer frame 15 is matched to the inner cross section of the collector space 6 and is brazed or merely connected mechanically to the latter. The relatively close-mesh filter screen 14 forms a cylindrical area which is arranged approximately coaxially with respect to the collector 5 but leaves a gap 16 in relation to the dividing wall 7. The dryer/filter insert 11, comprising the upper dryer part 12 and the lower filter part 14, is therefore introduced into the interior 6 and positioned before the brazing process in such a way that it is brazed or merely mechanically connected to the inner wall 17 of the collector 5 during the subsequent brazing process. Therefore, following the brazing operation, this insert is arranged in a fixed manner in the collector and can thus fulfill its function, as will be described below:

The refrigerant, which has previously flowed through the condenser in a known manner, flows through the overflow opening 8 in the wall 7 from the collecting pipe 2 into the interior 6 of the collector 5, as indicated by the arrows a and b. There, it comes into contact with the metal sleeve 12, flows through the perforation openings 12' and thus passes into the interior of the sleeve 12, where the granules 13 are located—the latter remove the water contained in the refrigerant. The granules 13 are commercially available and are resistant to brazing temperatures such as occur during the brazing of aluminum. The refrigerant then flows into the interior of the approximately cylindrical filter screen 14 and passes through the filter screen 14 from the inside to the outside, that is to say approximately in the radial direction, and then, as illustrated by the arrow c, flows via the overflow opening 9 in the wall 7 into the collecting pipe 2 again, that is to say into the chamber 18 located underneath the dividing wall 10. From there, it flows through the lowest tubes of the condenser to the outlet of the condenser.

A further embodiment of the dryer/filter insert is illustrated in FIG. 2. In all its important parts, it corresponds to the design according to FIG. 1, with the single difference that the dryer is formed as a dryer rod 20 made of a solid dryer compound. This compound contains the known drying material and is likewise temperature-resistant with respect to the brazing process. This dryer rod 20 therefore does not have any cage; it is fixed in the lower filter frame 15 in a manner not specifically illustrated.

A further exemplary embodiment is illustrated in FIG. 3. A condenser 30 comprises a heat-exchange network 31, which is formed by flat tubes 32 and corrugated ribs 33 arranged between them. The ends of the flat tubes 32 open into a collecting tube 34 and are brazed to the latter. The collecting tube 34 has, in a simplified illustration, an upper chamber 35 (a further subdivision into a plurality of chambers can also be provided) and also a lower chamber 36, which is divided off by a dividing wall 37. Arranged parallel to the collecting tube 34 is a tubular collector 38, which is sealed off at the ends in a pressure-tight and fluid-tight manner by a cover 39 and 40 in each case. The chamber 35 of the collecting tube 34 is connected to the interior of the collector 38 via an opening 41, and the lower chamber 36 has a fluid connection to the lower part 43 of the collector 38 via an overflow opening 42. Arranged in the interior 44 of the collector 38 is a dryer/filter insert 45, which substantially comprises a perforated, metallic tubular sleeve 46, which is fixed coaxially in the collector 38 by means of two ring-like flanges 48 and 49 arranged at the ends, leaving an annular gap 47. Within the perforated sleeve 46 there are dryer granules 50. The tubular sleeve 46 is sealed off at the ends by end plates (not illustrated) which are likewise perforated. At the lower end of the sleeve 46 there is additionally a filter screen 51 at the end.

The entire dryer/filter unit 45, including the ring-like flanges 48, 49, is introduced into the interior of the collecting tube 44 before the brazing process and is positioned there. The collector 38 is then closed by the two covers 39, 40. After that, the entire condenser prepared for the brazing process is put into the brazing oven and brazed there. Following the brazing process, the dryer/filter unit 45 is fully capable of functioning, which takes place in the following manner:

The refrigerant flows—in a manner analogous to the previous exemplary embodiments—following the arrow a via the overflow opening 41 firstly into the annular space 47 and from there via the perforation of the sleeve 46 into the interior of the latter. There, the refrigerant comes into contact with the granules 50, as a result of which dehydration takes place. From the interior of the sleeve 46, the refrigerant can escape both upward into the space 44 and downward into the space 43. In the upper part 44, the gaseous phase of the refrigerant will be collected, while the liquid phase will flow through the filter screen 51 into the lower space 43, so that primarily liquid refrigerate will be collected there; this then passes via the overflow opening 42 into the chamber 36 and then into the lowest tubes of the condenser, which generally form what is known as the undercooling section of the condenser.

| List of designations | |
|---|---|
| 1 | Refrigerant condenser |
| 2 | Collecting tube |
| 3 | Flat tube |
| 4 | Corrugated ribs |
| 5 | Collector |
| 6 | Interior |
| 7 | Wall |
| 8/9 | Overflow opening |
| 10 | Dividing wall |
| 11 | Dryer/filter insert |
| 12 | Metallic cage |
| 12' | Openings |
| 13 | Granules |
| 14 | Filter screen |
| 15 | Frame |
| 16 | Gap |
| 17 | Inner wall |
| 18 | Chamber |
| 20 | Dryer rod |
| 30 | Condenser |
| 31 | Heat-exchanger network |
| 32 | Flat tubes |
| 33 | Corrugated ribs |
| 34 | Collecting tube |
| 35/36 | Chamber |
| 37 | Dividing wall |
| 38 | Collector |
| 39/40 | Cover |
| 41 | Overflow opening |
| 42 | Overflow opening |
| 43 | Lower part of the collector |
| 44 | Interior of the collector |
| 45 | Dryer/filter insert |
| 46 | Sleeve |
| 47 | Annular space |
| 48/49 | Ring-like flange |
| 50 | Granules |
| 51 | Filter screen |

The invention claimed is:

1. A refrigerant condenser, produced by brazing and comprising a heat-exchanger network (31) with flat tubes (3, 32) and corrugated ribs (4, 33), collecting tubes (2, 34) which have a fluid connection to the flat tubes (3, 32), and also a collector (5, 38) which is arranged parallel to a collecting tube, accommodates a dryer and/or filter in itself and has a fluid connection to the collector (2, 34) via overflow openings (8, 9; 41, 42), characterized in that the dryer (11, 20, 46) and/or filter (14, 15; 51) is connected to the collector (5, 38) via a nondetachable connection produced before or during the brazing process.

2. The refrigerant condenser as claimed in claim 1, characterized in that the dryer comprises a perforated metal container (12, 46) which accommodates dryer granules (13, 50) in itself, and in that the metal container (12, 46) is connected to the inner wall of the collector (5, 7; 38).

3. The refrigerant condenser as claimed in claim 1, characterized in that the dryer (11, 20, 46) is connected to a filter screen (14, 51) which is connected to the inner wall of the collector (5, 38).

4. The refrigerant condenser as claimed in claim 2, characterized in that the metal container (12, 46) consists of an alloy that can be brazed and is brazed to the collector (5, 7, 38).

5. The refrigerant condenser as claimed in claim 3, characterized in that the filter screen (14, 51) consists of an alloy that can be brazed.

6. The refrigerant condenser as claimed in claim 1, characterized in that the dryer material consists of a solid compound (20).

7. The refrigerant condenser as claimed in claim 6, characterized in that the solid dryer compound (20) is connected to the filter insert (15).

8. The refrigerant condenser as claimed in claim 3, characterized in that the dryer and filter screen are formed as an integrated-unit (45) which, arranged in the collector (38), is connected to the collector (38).

9. The refrigerant condenser as claimed in claim 8, characterized in that dryer and filter screen are formed as a tubular unit (45), which is arranged coaxially in the collector (38) with an annular gap (47) and is connected to the collector (38) at the end.

10. The refrigerant condenser as claimed in claim 8, characterized in that the filter screen (51) is arranged at the end and/or coaxially.

11. A method for producing a refrigerant condenser as claimed in claim 1, characterized in that the dryer (11, 12; 20; 46) with drying material and/or the filter (14, 15; 51) is positioned in the collector (5, 38) before the brazing of the condenser (1, 30) and is connected to the collector either before the brazing or during the brazing.

* * * * *